US006386662B1

(12) United States Patent
Bui

(10) Patent No.: US 6,386,662 B1
(45) Date of Patent: May 14, 2002

(54) WIDE MOUTH BANKING DEPOSITOR

(75) Inventor: Xuan Bui, Culver City, CA (US)

(73) Assignee: Citicorp Development Center, Inc., Los Angeles, CA (US)

( * ) Notice: Subject to any disclaimer, the term of this patent is extended or adjusted under 35 U.S.C. 154(b) by 0 days.

(21) Appl. No.: 08/792,993

(22) Filed: Feb. 3, 1997

(51) Int. Cl.[7] ..... B41J 3/00
(52) U.S. Cl. ..... 347/2; 109/24.1
(58) Field of Search ..... 347/2, 3, 4, 105; 346/22; 235/379, 475, 485; 109/24.1, 23, 24, 53, 55, 46–49, 22; 232/43.1; 400/56; 271/55, 45–47, 2, 274–275

(56) References Cited

U.S. PATENT DOCUMENTS

| | | | | | |
|---|---|---|---|---|---|
| 4,162,651 | A | * | 7/1979 | Chertok | 101/287 |
| 4,558,373 | A | * | 12/1985 | Plasencia et al. | 358/285 |
| 4,631,556 | A | * | 12/1986 | Watanabe et al. | 347/32 |
| 4,884,679 | A | * | 12/1989 | Graef et al. | 198/718 |
| 4,997,176 | A | * | 3/1991 | Hain | 271/180 |
| 5,173,596 | A | * | 12/1992 | Kapinos et al. | 235/475 |
| 5,265,869 | A | * | 11/1993 | Morita | 271/274 |
| 5,648,811 | A | * | 7/1997 | Thiel et al. | 347/220 |
| 5,854,643 | A | * | 12/1998 | Katsuyama | 347/8 |

FOREIGN PATENT DOCUMENTS

| | | | | |
|---|---|---|---|---|
| DE | 3528926 | * | 2/1987 | 347/29 |
| JP | 63017764 | * | 1/1988 | |
| JP | 63017764 A | * | 1/1988 | B65H/29/20 |

* cited by examiner

*Primary Examiner*—N. Le
*Assistant Examiner*—Shih-wen Hsieh
(74) *Attorney, Agent, or Firm*—Blakely Sokoloff Taylor & Zafman

(57) ABSTRACT

A depositor accommodating substantially thicker deposits than was possible with prior systems. A pair of plates each having a transport mechanism disposed as part thereof are coupled to a housing so as to abut each other, one above the other, in a rest position. A drive shaft for the transport mechanisms of the upper and lower plates are rotatably coupled to the housing and define an axis of rotation for each plate. The drive shaft for the top plate is disposed at an opposite end from the drive shaft of the bottom plate. A free end of each plate, the end opposite the drive shaft, is elastically coupled to the housing. This allows a substantially thicker deposit envelope to be accepted than was possible with prior systems.

15 Claims, 5 Drawing Sheets

WIDE MOUTH BANKING DEPOSITOR

BACKGROUND OF THE INVENTION (1) Field of the Invention

The invention relates to a mechanism for accepting customer deposits. More specifically, the invention relates to an automated depositor which can receive customer deposits of bundles of cash and/or checks of widely varying thicknesses and with reduced maintenance.

(2) Related Art

Automated depositors have been widely used in the banking industry for many years. Depositors are typically incorporated into automatic teller machines (ATMs), which provide other after hours banking services in addition to those provided by the depositor. Prior art depositors typically have a front gate which covers a deposit receiving opening or mouth of the depositor. The gate is typically driven by a solenoid which, in turn, is activated responsive to the deposit request by a customer. When the gate opens, it exposes through the opening an upper and lower plate, one of which typically includes a drive belt which frictionally engages the envelope to be deposited. The plate with drive belt is typically fixed within the depositor and does not move regardless of the thickness of the envelope, e.g., the deposit, being deposited. The other plate typically floats so as to maintain pressure between itself and the envelope and, therefore, the drive belt and the envelope. In such case, the floating plate is smooth so as to reduce the probability of a jam caused by the envelope sticking on the floating plate.

The maximum float of the floating plate has typically been about one quarter inch. Thus, these prior art depositors typically only accommodated deposit envelopes having a maximum thickness of about a quarter of an inch. This is a major shortcoming in view of the fact that the deposits of many customers, particularly businesses, are typically in the range of a quarter of an inch to one inch. Moreover, it is often not convenient for businesses to make their deposits during normal banking hours, nor is it convenient for them to have to split the deposits into multiple deposits of a quarter inch or less in order to complete the daily deposits outside of banking hours.

Prior art depositors also include printing devices such as a dot matrix printer or an inkjet printhead disposed within the depositor to allow printing on the envelope being deposited. This allows the bank to identify the deposit by an account number and conduct the transaction with minimal employee time. The printing is particularly important as physical deposit slips with account numbers are typically no longer included with the deposit. The print mechanisms suffer a number of problems. Residual ink often clogs the jetports of the inkjet printer and results in illegible printing. In some cases, the printer could not process the data or print it during the limited exposure as the envelope is driven under the printhead. Either case results in wasted employee time matching an account to the items being deposited.

In view of the foregoing, it would be desirable to develop a depositor that accommodates a broader range of deposit thicknesses within improved printing reliability.

BRIEF SUMMARY OF THE INVENTION

A depositor accommodating thick deposits is disclosed. A pair of plates each having a transport mechanism disposed as part thereof are coupled to a housing so as to abut each other, one above the other, in a rest position. A drive shaft for the transport mechanisms of the upper and lower plates are rotatably coupled to the housing and define an axis of rotation for each plate. The drive shaft for the top plate is disposed at an opposite end from the drive shaft of the bottom plate. A free end of each plate, the end opposite the drive shaft, is elastically coupled to the housing. This allows a substantially thicker deposit envelope to be accepted than was possible with prior systems.

DETAILED DESCRIPTION OF THE INVENTION

Figure 1:
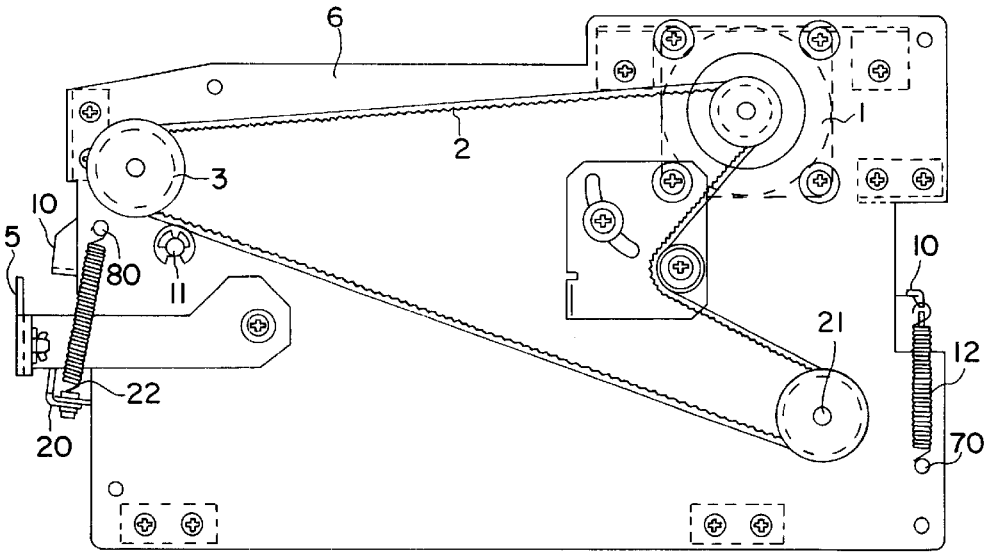
FIG. 1 is a right side view of a depositor of one embodiment of the invention with the right housing cover removed.

FIG. 1 is a right side view of a depositor of one embodiment of the invention with the right housing cover removed. A motor 1 is provided and coupled to housing 6. The motor 1 drives timing belt 2 which in turn directly drives drive shaft 21 and pulley 3. Timing belt 2 indirectly drives drive shaft 11 via pulley 3 and a gear assembly (not shown). The drive shafts 11 and 21 are rotatably coupled to housing 6. This rotatable coupling can be accomplished using bushings or other similar known technique. Drive shafts 11 and 21 drive the transport mechanisms of upper plate 10 and lower plate 20, respectively. One possible transport mechanism is one or more belts that surround drive shafts 11 and 21 wherein the belts are able to frictionally engage a depositable item. Spring 22 couples the lower plate 20 to the housing 6 at a connection point 80. Similarly, spring 12 elastically couples the upper plate 10 to the housing 6 at a connection point 70. A front gate 5 is coupled to the housing 6 and covers a mouth of the depositor when the depositor is installed in, for example, an ATM assembly.

Figure 2:
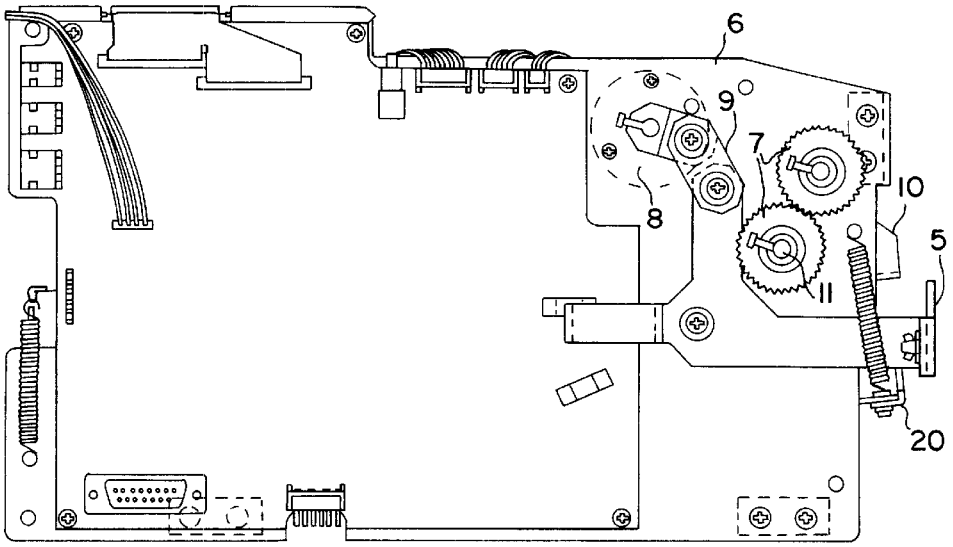
FIG. 2 is a left side view of depositor FIG. 1 with the left housing cover removed.

FIG. 2 is a left side view of depositor FIG. 1 with the left housing cover removed. Micromotor 8 is coupled to a housing 6 and drives linkage 9 to open gate 5 responsive to initiation of a deposit request. The micromotor 8 improves control and response over the prior art solenoid opening techniques. Gear assembly 7 allows motor 1 to drive drive shaft 11 such that drive belts (not shown) on plates 10 and 20 drive in the same direction. One such gear assembly includes a gear, a bearing and a shaft.

Figure 3:
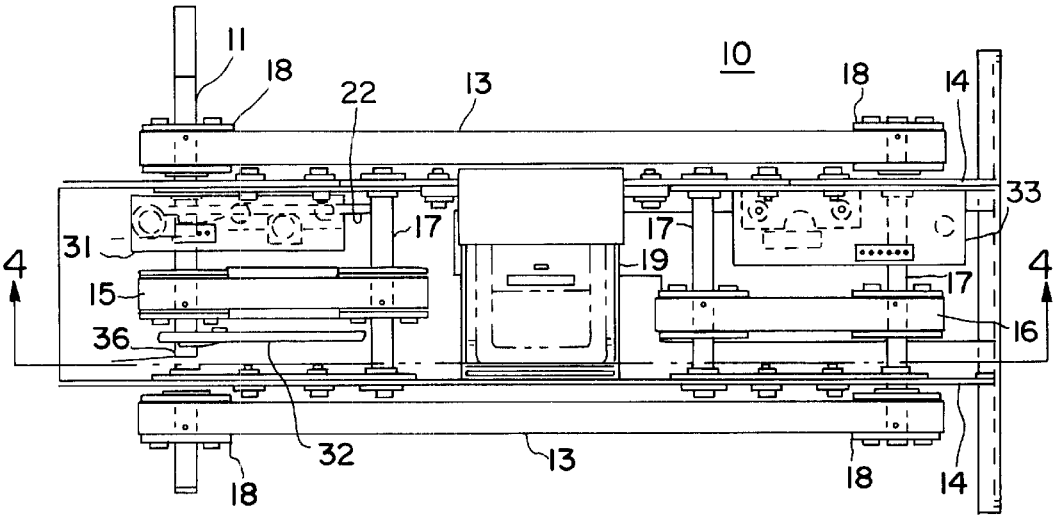
FIG. 3 is a top plan view of upper plate 10 in one embodiment of the invention.

FIG. 3 is a top plan view of upper plate 10 in one embodiment of the invention. Longitudinal members 14 support drive shaft 11 and a plurality of follower shafts 17. Two long drive belts 13 are disposed on pulleys 18 of opposing sides of the longitudinal members 14. A pair of short belts 15 and 16 are disposed between longitudinal members 14 and coupled to the drive and follower shafts by pulleys 18. A space is provided between front short belt 15 and rear short belt 16 in which print mechanism 19 is disposed. Anti-fishing hooks 32 are coupled to drive shaft 11 using a torsion spring 36. A first envelope sensor 31 is provided adjacent to short belt 15, while a second envelope sensor 33 is provided adjacent to short belt 16. The envelope sensors 31, 33 indicate when the deposit envelope has passed thereunder such that the gate 5 may be closed or a deposit accepted notification sent to the customer. Short belt 16 is offset, e.g., not co-linear with short belt 15. This allows accommodation of sensor 33, as well as clearing the print path such that no contact exists between the tray 10 and the print on the envelope created by print mechanism 19. It is important to minimize or eliminate contact with the printed surface to allow the ink the opportunity to dry without smearing.

Figure 4:
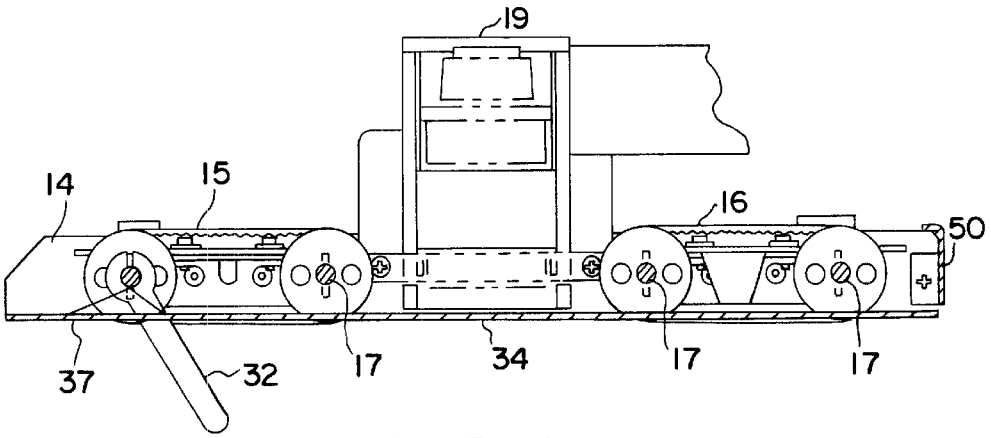
FIG. 4 is a sectional side view of the top plate of FIG. 3.

FIG. 4 is a sectional side view of the top plate of FIG. 3. Print mechanism 19 has printhead 34 disposed so as to be a predetermined distance from an envelope transported by the various drive belts, including short belts 15 and 16. This distance is maintained because the printhead floats with the plate. Upper plate 10 can pivot about an axis defined by drive shaft 11, but is restrained in a rest position by springs 12 (shown in FIG. 1). Thus, opposing end 50 can move in an upward arc above that pivot point, but the force exerted by springs 12 increases with displacement in accordance with Hooke's law. One or more stops (not shown) may be provided to ensure pivoting does not occur outside a maximum desired range. The pivoting of upper plate 10 and corresponding lower plate 20 occurs as a result of wedge action of a deposit envelope (described below). Accordingly, the springs 12 and 22 should be selected with sufficiently low spring constraints that within an established acceptable range, the resulting friction between plate 10 and plate 20 and the envelope will not over tax the motor 1 or result in a jam. The torsion spring 36 (as shown in FIG. 3) which the anti-fishing hook 32 is coupled to drive shaft 11 acts against the floor 37 of the plate 10.

Figure 5:
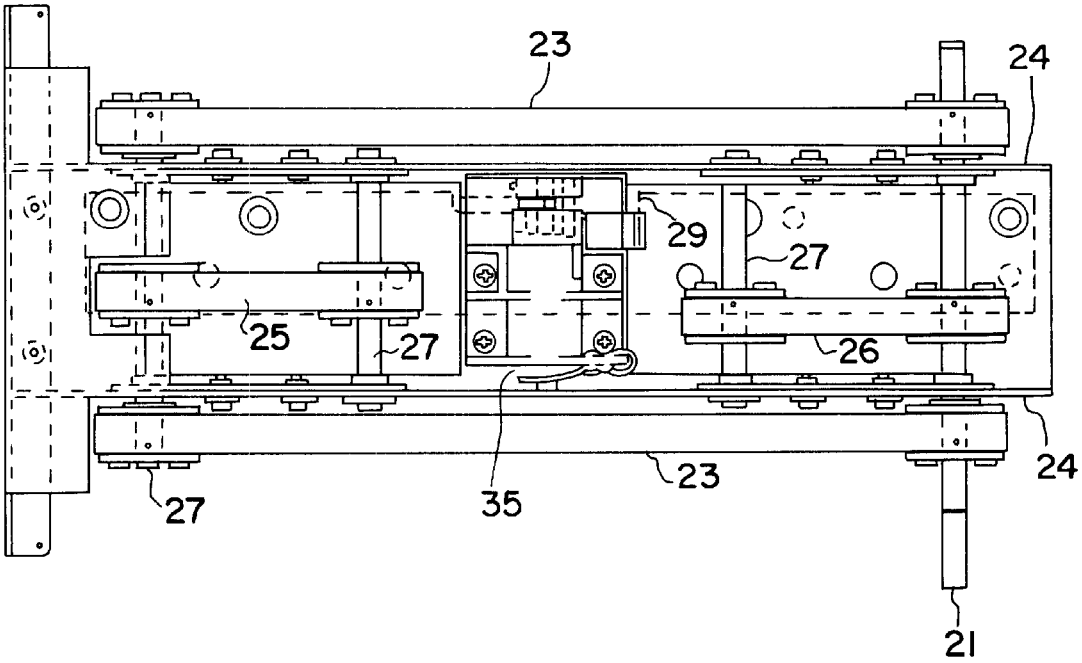
FIG. 5 is a plan view of the lower plate of one embodiment of the invention.

FIG. 5 is a plan view of the lower plate of one embodiment of the invention. Lower plate 20 has several structures corresponding to those found in the top plate. Specifically, lower plate 20 has a drive shaft 21 which drives two long drive belts 23 and two short drive belts 25 and 26. The belts are supported by pulleys coupled to drive shaft 21 and follower shafts 27. Significantly, drive shaft 21 is in the lower plate, the rear most shaft where the location of the front gate is defined to be the front. Similar to upper plate 10, lower plate 20 pivots about an axis defined by its drive shaft 21. Notably, this means that the front side of the lower plate 20 pivots, while the rear side of upper plate 10 pivots. Having effectively two floating plates, greater widths of deposit envelopes can be accommodated. In a preferred embodiment, the float of the upper plate 10 and lower plate 20 relative to each other allows deposit envelopes of up to one inch thickness to be deposited.

Lower plate 20 also includes a maintenance station 29 positioned so as to reside in a predetermined relation to the print mechanism 19 of the upper plate. The maintenance station 29 (described more fully with reference to FIGS. 6*a* and 6*b* below) is positioned between short belt 25 and short belt 26 of lower plate 20. The maintenance station is driven by a micromotor 35 coupled to the lower plate.

Figure 6A:
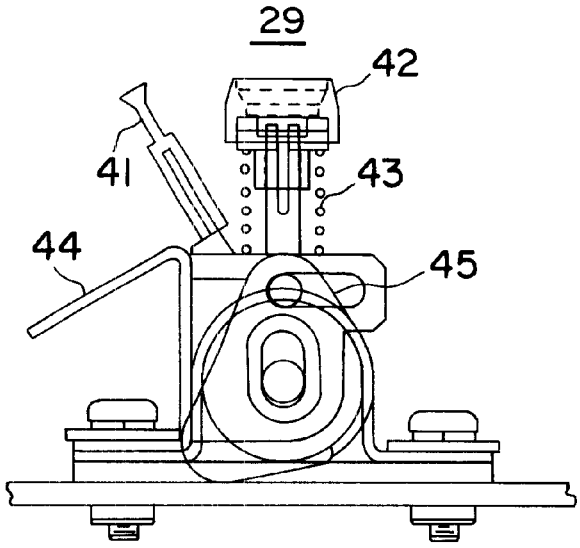
FIG. 6*a* shows a maintenance station 29 in a capping, or inactive, position.
Figure 6B:
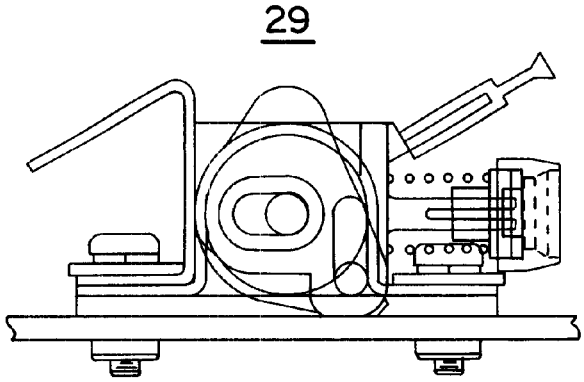
FIG. 6*b* shows the maintenance station 29 in the printing (deposit accepting) position.

FIG. 6*a* shows a maintenance station 29 in a capping, or inactive, position. A cam 45 is driven by the micromotor 35 to cause the wiper 41 and capping cup 42 to move through a predetermined arc. The wiper 41 clears residual ink from the printhead when it is driven over the printhead 33 in preparation for printing and following completion of a print. These periodic wipings of the printhead 33 reduce the probability of print malfunctions due to clogs of the inkjets. Additionally, the capping cup 42 which is disposed so as to cap the printhead when no deposit is occurring, decreases the air exposure of the printhead 33 and thereby makes it less likely for the printhead 33 to dry up. A spring 43 applies pressure on the lower side of the capping cup holding it in place. A stop 44 is provided to prevent the overrotation of the wiper capping cup assembly. FIG. 6*b* shows the maintenance station 29 in the printing (deposit accepting) position. In this position, the micromotor 35 has rotated the capping cup 42 90° such that it does not prevent passage of an incoming envelope. When the sensor 33 detects the envelope has passed, e.g., the deposit is accepted, the micromotor 35 rotates the capping cup 42 back into the capping position.

Figure 7:
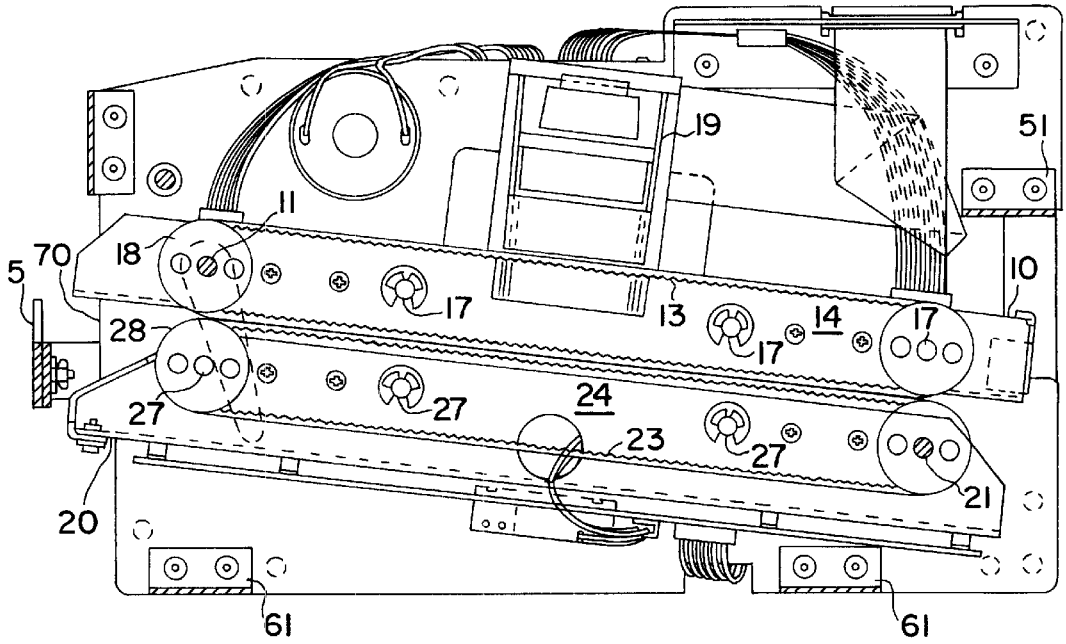
FIG. 7 is a sectional right side view of the depositor of one embodiment of the invention.

FIG. 7 is a sectional right side view of the depositor of one embodiment of the invention. As previously discussed, front gate 5 is opened responsive to a deposit request. Opening of gate 5 exposes mouth 70 into which a deposit envelope may be inserted. At the time the gate 5 opens, the drive belts 13 and 23, as well as a short drive belt (not shown), will already be being driven by the motor by drive shafts 11 and 21, respectively. The belts will, therefore, frictionally engage an inserted envelope drawing it into the depositor. The envelope will then serve as a wedge causing each plate to rotate about its axis of rotation along its respective drive shaft 11 or 21. A maximum rotation is constrained by stops 51 for the upper plate 10, and 61 for the lower plate 20. Notably, each plate rotates independently of the other plate. The displacement of each plate is related to the location of the envelope relative to the axis of rotation. Once the sensor 31 detects that the envelope is completely inside, the front gate 5 can be driven closed. The drive belts 13, 15, 16, 23, 25, and 26 will drive the envelope under the printhead 33 which will print a string of information on the envelope identifying the account and amount of the deposit. The envelope will then proceed across the plates and fall under the influence of gravity into a bin (not shown), thus, concluding the deposit.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

I claim:

1. A depositor comprising:

a housing, the housing defining an opening to accommodate a depositable item;

a first plate which maintains contact with a first side of the item, the first plate rotatably coupled to the housing at a first end and elastically coupled to the housing at a second end; and a second plate which maintains contact with a second side of the item, the second plate rotatably coupled to the housing at a second end and elastically coupled to the housing at the first end.

2. The depositor of claim 1 wherein the first plate comprises:

a first plurality of shafts coupled to a plurality of longitudinal members;

a first plurality of pulleys disposed on the shafts;

a first plurality of drive belts disposed on the pulleys; and a printhead coupled to the longitudinal members between a pair of the drive belts.

3. The depositor of claim 2 wherein the plurality of belts comprises:

a first and a second long belt disposed longitudinally on the first plate in a first and second side, respectively; and a first and a second short belt disposed parallel to and between the first long belt and the second long belt, the first and second short belts being disposed offset relative to each other and defining a space there between, the printhead disposed in the space, the first short belt in line with the printhead and the second short belt offset from the printhead.

4. The depositor of claim 2 wherein the second plate comprises:

a second plurality of shafts coupled to a second plurality of longitudinal members;

a second plurality of pulleys disposed on the shafts; and a second plurality of drive belts disposed on the second pulleys.

5. The depositor of claim 4 wherein the drive belts drive the item under the printhead and wherein the printhead is maintained a predetermined distance from the first side of the item regardless of a thickness of the item.

6. The depositor of claim 5 wherein the depositor accepts items with a thickness in the range of about 0.00 inches to about 1.00 inch.

7. The depositor of claim 4 further comprising:

a motor;

a timing belt coupled to the motor, the timing belt driving the first plurality of drive belts and the second plurality of drive belts at a uniform speed; and a gear assembly provided to cause the first and second drive belts to drive in a same direction.

8. The depositor of claim 4 wherein the second plate further comprises:

a maintenance station disposed in a predetermined relation to the printhead.

9. The depositor of claim 8 wherein the maintenance station is driven by a micromotor and wherein the maintenance station comprises a wiper and a capping cup.

10. The depositor of claim 1 wherein the second end of the first plate and the first end of the second plate are elastically coupled to the housing with springs, a displacement in the springs being approximately 0 when the plates abut each other.

11. The depositor of claim 1 further comprising a micromotor driven gate for covering the opening when no deposit is occurring.

12. A depositor comprising:

a housing, the housing defining an opening to accommodate an item to be deposited;

a first plate which maintains contact with a first side of the item, the first plate rotatably coupled to the housing at a first end and elastically coupled to the housing at a second end, the first plate comprising a first plurality of shafts coupled to a plurality of longitudinal members, a first plurality of pulleys disposed on the shafts, a first plurality of drive belts disposed on the pulleys and a first printhead coupled to the longitudinal members between a pair of the drive belts, wherein one shaft of the first plurality of shafts is a drive shaft driven by a motor rotatably coupled to the housing, the drive shaft defining a pivot point about which the plate can rotate; and a second plate which maintains contact with a second side of the item, the second plate rotatably coupled to the housing at a second end and elastically coupled to the housing at the first end.

13. A depositor comprising:

a housing, the housing defining an opening to accommodate a depositable item; and a first plate and a second plate are coupled to the housing, each plate including a transport mechanism for engaging a first side and a second side of the depositable item and the first plate being independently movable relative to the second plate and the second plate being independently movable relative to the first plate, wherein the first plate has a printhead coupled thereto, and the second plate has a maintenance station coupled thereto for maintaining the printhead.

14. A depositor comprising:

a housing, the housing defining an opening to accommodate a depositable item; and a first plate and a second plate are coupled to the housing, each plate including a transport mechanism for engaging a first side and a second side of the depositable item and the first plate being independently movable relative to the second plate and the second plate being independently movable relative to the first plate, wherein the second plate has a printhead coupled thereto, and the first plate has a maintenance station coupled thereto for maintaining the printhead.

15. A depositor comprising:

a housing, the housing defining an opening to accommodate a depositable item; and a first plate and a second plate are coupled to the housing, each plate including a transport mechanism for engaging a first side and a second side of the depositable item and the first plate being independently movable relative to the second plate and the second plate being independently movable relative to the first plate, wherein the first plate and the second plate are elastically coupled to the housing such that the depositor accommodates depositable items of varying width.

* * * * *